US005767758A

United States Patent [19]

Sakamaki

[11] Patent Number: 5,767,758

[45] Date of Patent: Jun. 16, 1998

[54] PLUG CAP INCORPORATED TYPE IGNITION COIL

[75] Inventor: Makoto Sakamaki, Saitama, Japan

[73] Assignee: Toyodenso Kabushiki Kaisha, Tokyo, Japan

[21] Appl. No.: 527,323

[22] Filed: Sep. 12, 1995

[30] Foreign Application Priority Data

Sep. 14, 1994 [JP] Japan ..... 6-247339

[51] Int. Cl.[6] ..... H01F 27/36; H01F 27/02; H01F 27/30

[52] U.S. Cl. ..... 336/84 M; 336/96; 336/107; 336/110; 336/198

[58] Field of Search ..... 336/96, 90, 110, 336/145, 192, 205, 198, 107, 100, 84 M, 84 R; 123/634

[56] References Cited

U.S. PATENT DOCUMENTS

| | | | |
|---|---|---|---|
| 2,461,098 | 2/1949 | Weatherly . | |
| 3,686,599 | 8/1972 | Lee | 336/96 |
| 4,514,712 | 4/1985 | McDougal | 336/96 |
| 4,532,398 | 7/1985 | Henriksson | 336/96 |
| 5,128,646 | 7/1992 | Suzuki et al. . | |
| 5,144,935 | 9/1992 | Taruya et al. . | |
| 5,146,906 | 9/1992 | Agatsuma . | |
| 5,507,089 | 4/1996 | Dickmeyer | 336/96 |

FOREIGN PATENT DOCUMENTS

| | | | |
|---|---|---|---|
| 4-143461 | 5/1992 | Japan . | |
| 814832 | 6/1959 | United Kingdom | 336/96 |

*Primary Examiner*—Thomas J. Kozma
*Attorney, Agent, or Firm*—Birch, Stewart, Kolasch & Birch, LLP

[57] ABSTRACT

A plug cap incorporated type ignition coil is provided with a primary coil 20 and a secondary coil 30 inserted in a case 10. After a cushion member 80, a magnet 82, and then a core 40 are inserted in order in a primary coil bobbin 22 of a generally cylindrical bottomed shape, the case 10 is filled with potting resin 70. There is interposed a bottom wall portion of the primary coil bobbin 22 between one end 42 of the core 40 and the potting resin 70. Accordingly, even though stress resulting from the difference in thermal shrinkage between the core 40, the primary coil bobbin 22 and the potting resin 70 is caused, the stress is absorbed by elasticity of the primary coil bobbin 22 and as a result, the potting resin 70 is hard to cause a crack. Also, even though the core is affected by the thermal shrinkage, the magnet 82 is hard to destroy.

3 Claims, 3 Drawing Sheets

B
B
1
2
3
4
5
6
7
8
9
a
b 1
4
5
9
a

PLUG CAP INCORPORATED TYPE IGNITION COIL

BACKGROUND OF THE INVENTION

1. Field of the Invention

This invention relates to a plug cap incorporated type ignition coil.

2. Description of the Art

An example of such a plug cap incorporated type ignition coil is disclosed in Japanese Laid-Open Patent Publication (Kokai) No. Hei 4-143461. FIG. 4 schematically shows essential parts of this conventional ignition coil, in which FIG. 4(A) is a sectional view in the axial direction and FIG. 4(B) is a sectional view taken along line B—B of FIG. 4(A). This plug cap incorporated type ignition coil comprises a generally cylindrical bottomed case 1 having one end opened and the other end provided with a bottom wall portion which has a terminal hole, a primary coil 3 and a secondary coil 4 both accommodated in the case 1, a core 5 inserted in the axial portion of these coils, a secondary output terminal 6 projecting in the longitudinal direction of the coils to pass through the terminal hole and then enter a plug cap 2. This allows thereby the projecting end thereof to contact a plug terminal of a spark plug. The plug cap incorporated type ignition coil further comprises a coupler 7 provided on the opened end of the case 1, and magnets 8 provided at both ends of the core 5, wherein the case 1 is filled with potting resin 9.

PROBLEM TO BE SOLVED BY THE INVENTION

In such a conventional ignition coil, the core 5 of metal and the potting resin 9 are in direct contact with each other and therefore a crack is sometimes produced in the resin such as the potting resin 9 by stress resulting from the difference in thermal shrinkage between them. Since a resin member such as the potting resin 9 is apt to produce large stress, especially in the longitudinal direction of the core 5, cracks a and b are easily generated toward the outside from each corner portion of the end of the core 5. Also as shown by the letter a in FIG. 4(B), there are cases where such cracks as to enter coil bobbins are generated. Once such cracks are generated, electricity leakage occurs between the core 5 and the secondary coil 4 and as a result, withstand voltage performance drops. It is also required to prevent the magnets 8 from being destroyed by the thermal shrinkage of the core 5.

It is therefore an object of the present invention to overcome the disadvantages described above.

SUMMARY OF THE INVENTION

In order to overcome such disadvantages as described above, according to the present invention, there is provided a plug cap incorporated type ignition coil comprising a generally cylindrical bottomed case having one end opened and the other end provided with a bottom wall portion which has a terminal hole, a plug cap secured on the side of the bottom wall portion, primary and secondary c oils both accommodated in the case, a core inserted in the axial portion of these coils, a secondary output terminal projecting in the longitudinal direction of the coils to pass through the terminal hole of the bottom wall portion of the case, thereby allowing the projecting end to enter the plug cap, and a coupler provided on the open end of the case, wherein the case is filled with potting resin, and a primary coil bobbin of the primary coil is made of a flexible material to have a generally cylindrical bottomed shape, wherein a magnet and then the core are inserted in order in the space of the primary coil bobbin from the open end thereof, thereby allowing a bottom wall portion of the primary coil bobbin to interpose between the magnet and the potting resin.

With this construction, there is interposed the bottom wall portion of the primary coil bobbin between the core and magnet and the potting resin and as a result, the core and magnet corner and the potting resin are no more in direct contact with each other.

Accordingly, even though there is produced stress resulting from the difference in thermal shrinkage between the core and the resin portion therearound, such stress may be absorbed by elasticity of the primary coil bobbin and as a result, the potting resin and the primary coil bobbin are hard to produce a crack. The magnet is also kept from being destroyed. It is therefore not only possible to prevent a leak of electricity resulting from generation of the crack, but also to improve the voltage performance.

In this case, it is preferable to interpose a cushion member between the magnet and the bottom wall portion of the primary coil bobbin.

With this construction, the thermal shrinkage of the core can also be absorbed by this cushion member and it is therefore possible to prevent the potting resin from producing the crack. Also, since force applied to the magnet by the thermal shrinkage of the core is reduced, the magnet is hard to destroy and therefore its durability improves.

Further, a peripheral wall portion may be integrally formed with the open end portion of the primary coil bobbin to project outside in the axial direction of the case, wherein the space inside the peripheral wall portion may be adapted to serve as a magnet accommodating portion for accommodating the magnet. It is preferable to cover the peripheral wall portion by a magnet cap formed at a part of the coupler which is situated on the side of the open end of the case.

With this construction, the inside of the peripheral wall portion serves as the magnet accommodating portion and it is easier to position the magnet when accommodated therein. Also, when the magnet cap formed at the coupler is mounted on the peripheral wall portion in such a magnet accommodating condition, it is possible to thoroughly shield the magnet from the potting resin. Therefore, even though internal stress is produced when the potting resin is hardened in filling operation, the magnet is shielded by the wall portion and the magnet cap and there is no risk of destruction. Furthermore, since each corner of the magnet and the potting resin are not in direct contact with each other, there is no such a possibility of producing the crack in the potting resin by the difference in thermal shrinkage between the core and the potting resin. It is further possible to prevent the magnet from being damaged by a shock caused when the parts are assembled.

On the other hand, when the stress resulting from the difference in the thermal shrinkage between the core and the primary coil bobbin is designed to be absorbed by the cushion member provided between the magnet and the bottom wall portion of the primary coil bobbin, the primary coil bobbin need not necessarily be a flexible material.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
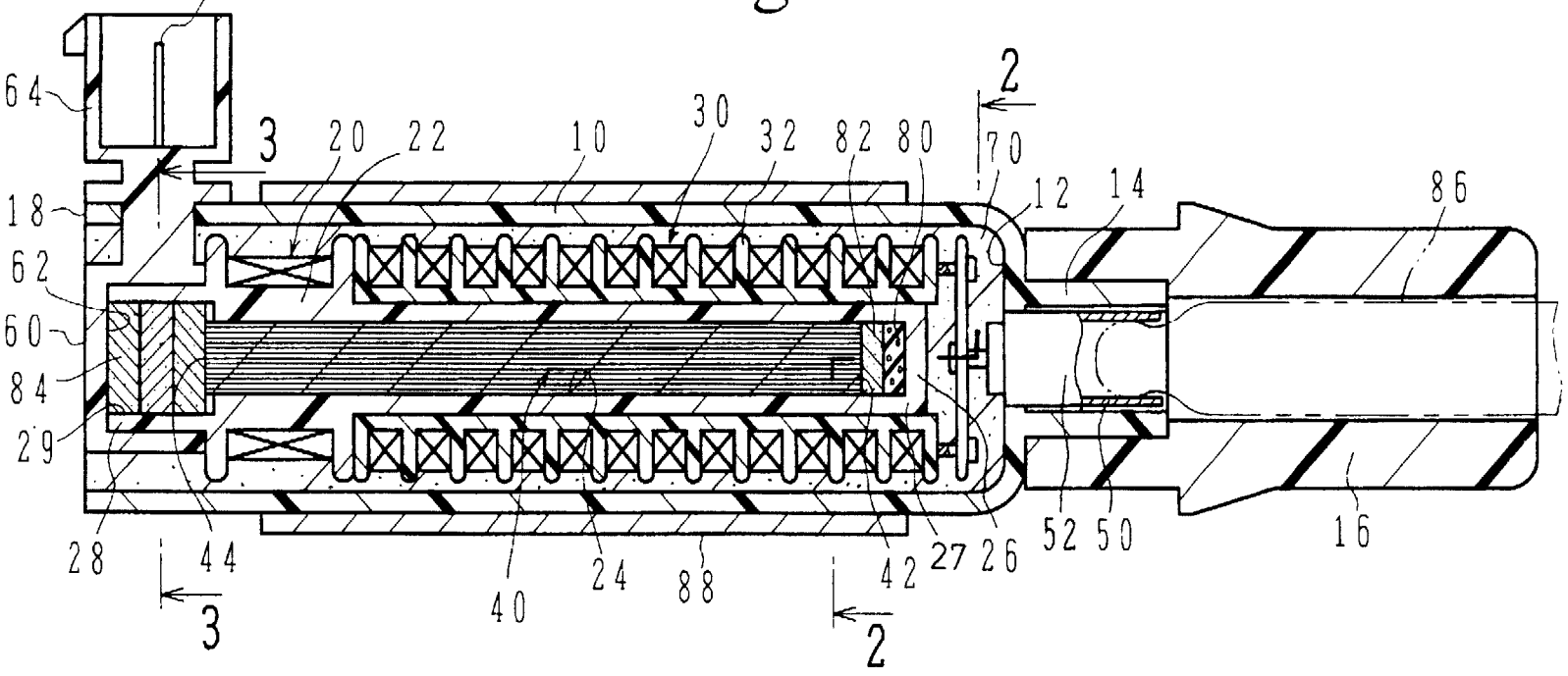
FIG. 1 is an axial sectional view of a plug cap incorporated type ignition coil according to the present embodiment.
Figure 2:
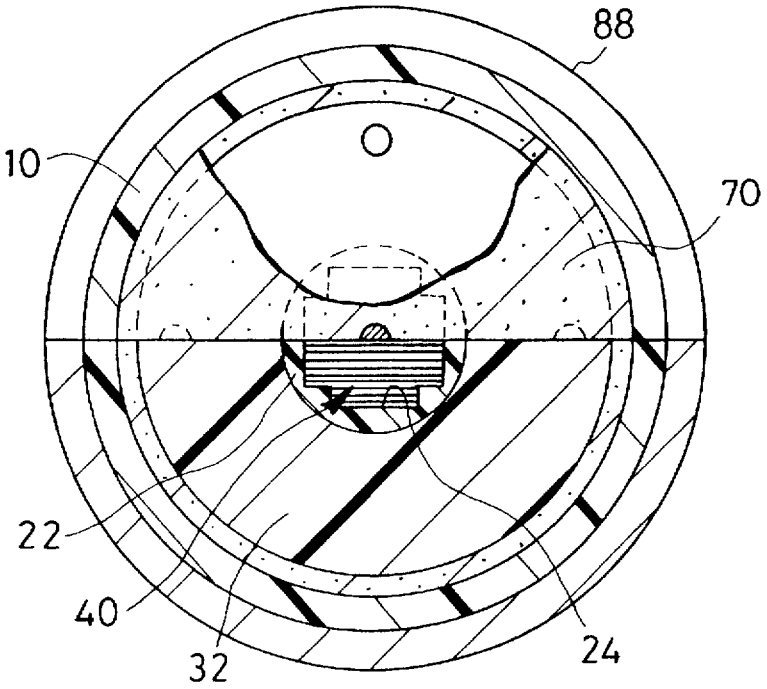
FIG. 2 is a cross-sectional view taken along line 2—2 of FIG. 1
Figure 3:
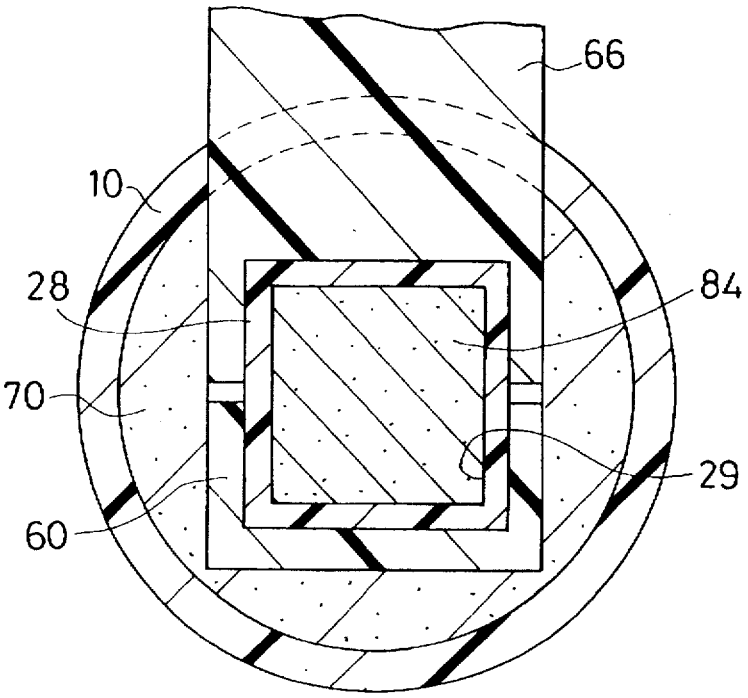
FIG. 3 is a cross-sectional view taken along line 3—3 of FIG. 1.
Figure 4A:
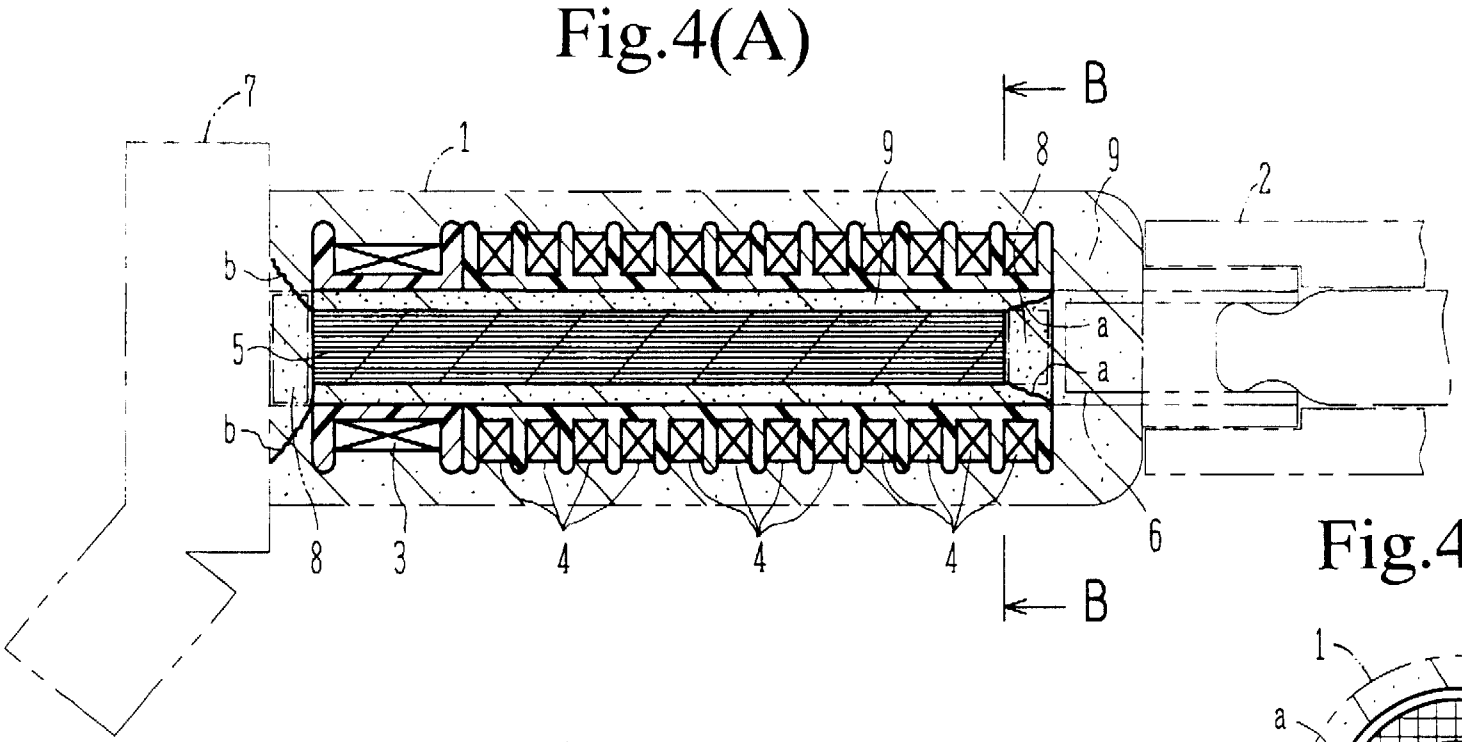
FIGS. 4 (A) and (B) are diagrammatic explanatory views of the conventional ignition coil.
Figure 4B:
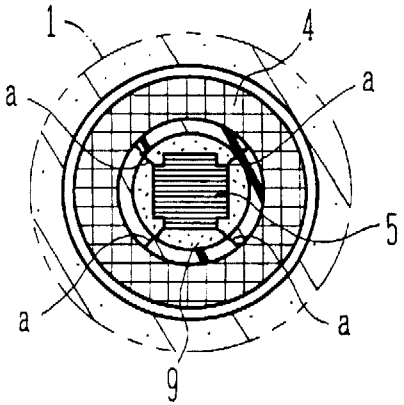

One embodiment according to the present invention will be described with reference to FIGS.1 through 3. FIG. 1 is an axial sectional view of a plug cap incorporated type ignition coil according to the present embodiment. FIG. 2 is a cross-sectional view taken along line 2—2 of FIG. 1 and FIG. 3 is a cross-sectional view taken along line 3—3 of FIG. 1.

In FIG. 1, this plug cap incorporated type ignition coil comprises a case 10, a primary coil 20, a secondary coil 30, a coil 40, a secondary output terminal 50, and a magnet cap 60, wherein the case 10 is filled with potting resin 70. Also, the core 40 is provided at its one end with a cushion member 80 and a magnet 82 and at its other end with another magnet 84.

The case 10 is a generally cylindrical bottomed member made of an insulating material and its bottom wall portion 12 is provided with a cylindrical projecting portion 14 of a smaller diameter than that of the case 10 which projects in the axial direction. A plug cap 16 is arranged to engage with the outer peripheral portion of the projecting portion 14. The other end 18 of the case 10 is formed to have an open end.

The primary coil 20 is formed on the outer peripheral portion of a long primary coil bobbin 22 made of a flexible insulating material such as a material which impregnated PBT or PET with elastomer or rubber and near the end portion of the side of an open end 18 of the case 10. The primary coil bobbin 22 is a generally cylindrical bottomed member provided with a core inserting hole 24 for accommodating the core 40 along an axial overall length. The bobbin 22 is fully blocked at its one end by a bottom wall portion 26 and provided at its other end with a peripheral wall portion 28 (see FIG. 3) of a generally square cross-sectional shape which extends further as a rib shape from the end portion of the primary coil 20 toward the side of the open end 18 of the case 10. The space inside the peripheral wall portion 28 serves as a magnet accommodating portion 29.

The secondary coil 30 is formed in a row in th e same axial direction as the primary coil 20 and on the side of the secondary output terminal 50. A secondary coil bobbin 32 is arranged to engage with the outer peripheral portion of the primary coil bobbin 22. The secondary coil 30 is connected to the primary coil 20 at the end portion of the side of the primary coil 20 and it is also connected to the secondary output terminal 50 at the end portion 52 of the side of the secondary output terminal 50 connection not shown, thereby allowing voltage to increase from the side of the primary coil 20 toward the side of the secondary output terminal 50.

The core 40 is a known metal member which has many laminated beltlike members having almost the same overall length as that of the primary coil bobbin 22 and there are interposed the cushion member 80 and the magnet 82 between one end portion 42 on the side of the secondary output terminal 50 and the bottom wall portion 26 of the primary coil bobbin 22. The cushion member 80 is a member adapted to absorb a change resulting from thermal shrinkage of the core 40 and is made of an elastic resin material such as silicone rubber or synthetic rubber.

The other end 44 of the core 40 faces the inside of the magnet accommodating portion 29 and is arranged to contact with another magnet 84 which is accommodated in the magnet accommodating portion 29. The secondary output terminal 50 projects from the bottom wall portion 26 of the primary coil bobbin 22 into the inside of the projecting portion 14 of the case 10 and the projecting end contacts a plug electrode 86 of a spark plug which is adapted to engage with the inside of the plug cap 16, thereby allowing secondary voltage of the secondary coil 30 to apply from the secondary output terminal 50 to the plug electrode 86.

The magnet cap 60 is provided with a recess 62 for engaging with the peripheral wall portion 28 and a part thereof is integrally formed with a coupler 64 which projects outside the case 10. A terminal 66 in the coupler 64 is connected to an input terminal of the primary coil 20.

The potting resin 70 is a known resin such as epoxy resin and filled between the internal surface of the case 10, the primary coil 20, the secondary coil 30, the secondary output terminal 50, and the magnet cap 60 to make them waterproof and insulated. A magnetic shielding member 88 is provided on the outer circumferential portion of the case 10 and on all circumference of the primary coil 20 and the secondary coil 30.

When it is required to assemble this plug cap incorporated type ignition coil, the secondary coil 30 is first arranged to engage with the outer periphery of the primary coil bobbin 22 for unification and then the cushion member 80 and the magnet 82 are inserted in order from the side of the peripheral wall portion 28 into the inside of the core inserting hole 24 of the primary coil bobbin 22 followed by the core 40. Next, the magnet 84 is inserted into the inside of the magnet accommodating portion 29 and the magnet cap 60 is then mounted on the peripheral wall portion 28 to cover it, thereby forming a small assembly unit.

This small assembly unit is inserted into the case 10 and the secondary output terminal 50 is arranged to engage with the inside of the projecting portion 14. After this operation, unvulcanized potting resin 70 is filled from the side of the open end 18 into the case 10 and then hardened so as to get a unified completed products.

The operation of the present embodiment will now be described. In FIG. 1, the core 40 is accommodated in the flexible primary coil bobbin 22 and both ends thereof 42 and 44 are respectively isolated from the potting resin 70 by the bottom wall portion 26 and the magnet cap 60. It is also to be noted that the end portion 42 of the core 40 and the corner of the magnet 82, and the potting resin 70 are not in direct contact with each other.

Accordingly, even though there is a big difference in thermal shrinkage between the core 40 of metal and the resin portion such as the primary coil bobbin 22 and the potting resin 70, the stress resulting from this thermal shrinkage is absorbed by the primary coil bobbin 22 and it does not affect the potting resin 70.

As a result, it is easy to prevent generation of cracks that extend from both the ends of the core 40 to the inside of the potting resin 70 and cracks that enter the inside of the primary coil bobbin 22. It is also hard for the magnet 82 to be destroyed.

Furthermore, on the side of the end portion 42 of the core 40 there is interposed the cushion member 80 between the magnet 82 and the bottom wall portion 26 and as a result, the thermal shrinkage of the core 40 can be absorbed by the deformation of this cushion member 80. Accordingly, it is easy to prevent the generation of a crack at the primary coil bobbin 22 and especially at the corner portion 27 of the bottom wall portion 26 by the stress resulting from the thermal shrinkage of the core 40 and it is also possible to prevent the magnets 82 and 84 from being damaged.

On the other hand, on the side of the end portion 44 of the core 40, the peripheral wall portion 28 facilitates positioning of the magnet 84 when assembled and as a result, it is possible to improve the work efficiency. Since the magnet 84 is enclosed by the peripheral wall portion 28 and the magnet cap 60, even though there is caused internal stress resulting from the filling and hardening of the potting resin 70, it is possible to shield such internal stress applied to the magnet 84 and therefore possible to prevent the damage of the magnet 84.

It will be understood that the present invention may be embodied with other changes, modifications and improvements. For example, when the cushion member 80 is arranged to absorb the stress caused by the difference in the thermal shrinkage between the core 40 of metal and the primary coil bobbin 22, the primary coil bobbin 22 need not necessarily be a flexible material.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A plug cap incorporated type ignition coil comprising:

a generally cylindrical bottomed case having one end opened and the other end provided with a bottom wall portion which has a terminal hole;

a plug cap secured on the side of the bottom wall portion;

primary and secondary coils having primary and secondary bobbins accommodated in the case, said primary coil bobbin is integrally formed at its open end with a peripheral wall portion which projects outside in the axial direction of the case; said primary coil bobbin is disposed in and contacts said secondary bobbin;

a core inserted in the axial portion of said primary and secondary coils;

an output terminal projecting in a longitudinal direction of the coils to pass through the terminal hole of the bottom wall portion of the case, thereby allowing a projecting end to enter the plug cap;

a coupler provided on the side of the open end of the case, the case is filled with potting resin about the primary and secondary coil bobbins in the case, said primary coil bobbin of the primary coil is made of a flexible material to have a generally cylindrical bottomed shape;

a magnet disposed adjacent to said core and in the axial portion of said primary and secondary coils;

a cushion member interposed between said magnet and a bottom wall portion of the primary coil bobbin, said cushion member absorbs thermal shrinkage and expansion of said core; and a cap formed at a part of the coupler which is situated on the side of the open end of the case, said cap is mounted on the peripheral wall portion and substantially covers said peripheral wall portion, whereby stress due to thermal shrinkage and expansion of said core and said potting resin is absorbed by said cushion member, while cracks in said potting resin and said primary coil bobbin and damage to said magnet are substantially reduced.

2. The plug cap incorporated type ignition coil according to claim 1, wherein said magnet in said primary coil bobbin is a first magnet, a space inside the peripheral wall portion of said cap is adapted to serve as a magnet accommodating portion for accommodating a second magnet, and said cap is mounted on the peripheral wall portion to cover said second magnet.

3. The plug cap incorporated type ignition coil according to claim 1, further comprising:

a magnetic shielding member provided on an outer circumferential portion of said case to cover said primary and secondary coils.

* * * * *